US006237291B1

(12) United States Patent
Elwart

(10) Patent No.: US 6,237,291 B1
(45) Date of Patent: May 29, 2001

(54) FLOOR RECEIVING CONCRETE BLOCK

(76) Inventor: John Ernest Elwart, P.O. Box 5342, Playa Del Rey, CA (US) 90296

( * ) Notice: Subject to any disclaimer, the term of this patent is extended or adjusted under 35 U.S.C. 154(b) by 0 days.

(21) Appl. No.: 09/371,666

(22) Filed: Aug. 10, 1999

(51) Int. Cl.[7] ..... E04B 1/00
(52) U.S. Cl. ..... 52/250; 52/294; 249/34
(58) Field of Search ..... 52/293.1, 294, 52/250; 405/229; 249/5, 13, 14, 34

(56) References Cited

U.S. PATENT DOCUMENTS 2,198,011 * 4/1940 Muirhead .
2,960,745 * 11/1960 Wallace .
4,051,642 * 10/1977 Terry ..... 52/294 X
4,328,651 * 5/1982 Gutierrez ..... 52/293.1
4,389,831 * 6/1983 Baumann ..... 249/34 X
4,422,617 * 12/1983 Gallis ..... 249/34 X
4,569,167 * 2/1986 Staples ..... 52/293.1
5,685,115 * 11/1997 Colfer ..... 52/294 X
5,882,540 * 3/1999 Farrington ..... 249/34
5,934,036 * 8/1999 Gallagher ..... 52/250 X

* cited by examiner

*Primary Examiner*—Robert W. Gibson, Jr.

(57) ABSTRACT

A concrete block is provided for integrated use directly above the footing whereby the block has one unobstructed longitudinally extending single cell half the block depth. The remaining opposing cell is longitudinally unobstructed and horizontally divided, having a solid flat shortened base to provide a third cavity below the remaining cell whereby the third cavity is a downsliding horizontal unobstructed cell the full block length. Each end of the block of the third cavity are open to allow a continuous flow of liquid concrete in which a floor pour can be received into the third cavity which is also the lower remaining half-cell of the block. Wall and floor can be poured separately with end of floor entered directly into sides of lower block cavity. When the concrete hardenes, a non-unified wall and floor results with both conjoined in the same structure above the footing level.

2 Claims, 2 Drawing Sheets

FLOOR RECEIVING CONCRETE BLOCK

FIELD OF THE INVENTION

The present invention relates to building construction and more particularly to a novel device for combining a wall and a floor poured of concrete, into the same structure, but with separate pours.

The present invention is a concrete block, made differently than a conventional block, with a horizontal cell on the lower longitudinal side of the block. This allows floor poured concrete to enter half the depth of the block on the lower side. The horizontal cell is open on each end, but closed to the wall pouring cells. The present invention enables two separate pours to be used for floor and wall, and at any time difference interval. The uniqueness of this invention is that the design of this block causes the terminated end of any concrete floor in conjunct use with a concrete block wall; end up inside of half the depth of the wall itself. Since, with its use, this block is mounted directly on top of the footing, the resulting floor poured with its use is a floor that is poured above the top of the footing elevation and into the the first block above the footing. With its use, a floor filled in the manner described will have less potential for leaks than conventional methods. The present invention, is a product and not a method.

DESCRIPTION OF THE RELATED ART

In the art of constructing buildings, and in particular, buildings made of concrete blocks, most block buildings are built first and then after the necessary plumbing and electrical work is finished, the floor is poured. So many inventors with their magnificent but complicated methods and systems have made building a building so time consuming that the relative cost of combining a footing with a floor is not even worth it. Another inventor will have a chemical sealant patent to solve the mess of seam leaks between the floor and footing. Yet another inventor may have waterproof cement to solve the problem. However in a conventional two piece pour system, which incidentally, is more often used than any other method, it is obvious that something is missing in existing methodology because the preferred method of two separate pours which is the main method used, regardless of patents, is being used probably because one pour methods are too time consuming, too expensive, or did not really make the drastic improvement as expected.

While, idealistically, one pour systems are superior, the consumer is more concerned for dollar savings than anything else. As long as the floor is above the footing is all that really matters, as in wood construction. However in block construction, the floor is rarely above the footing; if it is somewhat higher in elevation, seams will exist between the floor and footing at their vertical meeting point. If a vertical meeting point for a seam between floor and footing could be analyzed and scheduled for a better and less potentially troublesome location, the result would be less leakage, insects, odors, etc.

Instead of the consumer feeling locked in to a one piece pour as the only solution to a leak problem that probably does not really exist in the magnitude to need a one piece pour, it might be a better solution to use a concrete block as described in the present invention to schedule a location of the terminated end of a floor when poured. The present invention is a product and not a method and its use will not take any more labor time than a conventional widely used two pour system.

Other methods exist to provide the consumer with a preventive system which provides a one piece pour to combine the floor and footing. While the present invention is not a one pour system, the references will show a comparable method.

In U.S. Pat. No. 5,367,845 to Hartling, the invention discloses several plastic interfitting shells that ultimately enable the footing, floor, and wall to be poured simultaneously. Respective to Hartling, the invention even provides a casting mold for concrete blocks as a negative to a real concrete block.

The result is that polystyrene is left on the center and ends as well as the outside of the block negative. This is used as an R-18 or better insulator. If a consumer wants to pay for all of the shells and braces and time to prepare the system there probably is no better system.

Respective to U.S. Pat. No. 2,960,745 to Wallace, the inventor discloses a method of constructing a footing and floor construction apparatus whereby in a conventional two pour system, Wallace discloses the use of expansion strips to prevent cracking between footing and floor.

U.S. Pat. No. 4,635,895 to Johnson, Jr. et. al., discloses a method which enables the simultaneous pouring of a footing and floor slab. This method is a device which must be juxtapositioned and secured to work properly. The present invention, however, is a product that fits into a wall plan and needs no adjusting.

U.S. Pat. No. 4,328,651 to Gutierrez, discloses a precast concrete block system in which a non-conventional series of concrete interfitting parts are fitted together with metal rods and unified through hollow channels that become filled with liquid grout after all the pieces are erected to the desired shape of a building. The block sections are stabilized by a grade beam. This differes from the present invention, as the present invention is an adaptation of common cinder block and designed to fit in to the schedule of normal conventional concrete block wall manufacture.

U.S. Pat. No. 5,934,036 to Gallagher, Jr., discloses a wall forming systen in which concrete walls and floors are poured by forming the parts with insulation that is strong enough to hold liquid concrete until it sets. There is an interfitting design in the molding insulation apparatus which interlocks the floor with the wall. However the above mentioned patent is a series of plastic molding parts to form walls and slab floors, whereby the present invention is a concrete block designed to interlock a wall of concrete blocks and a slab floor.

U.S. Pat. No. 4,051,642 to Terry discloses a precast modular footing sections in pieces to assemble and a precast floor in sizable portions to be assembled. This entire invention is a movable, sectional system and is beyond the scope of the present invention.

U.S. Pat. No. 5,685,115 to Colfer discloses a integrated wall panel that utilizes steel studs connected to reinforcing bar and the bar is immersed in concrete. When the footing hardens, the reinforcing rods are threadably connected to the bottom steel studs. This patent is beyond the scope of the present invention.

U.S. Pat. No. 4,389,831 to Baumann discloses a device that enables a wall, floor and ceiling to be poured with concrete in rapid succession. There are no blocks in this invention. Therefore it is beyond the scope of the present invention.

U.S. Pat. No. 5,882,540 to Farrington discloses a wall casting device which is a simultaneous mold for a wall and a footing. The Patent has no provisions for a floor and is only a casting mold whereby the present invention is a concrete block adapted by its design, to interfit a wall and a floor slab.

U.S. Pat. No. 4,422,617 to Gallis discloses, again another method supported by a device, that is a molding structure for a concrete wall. This patent is beyond the scope of the present invention.

U.S. Pat. No. 4,569,167 to Staples discloses a modular housing component system, including walls, a floor, footings and a roof. The footing section of this patent discloses a precast above the ground footing made of concrete which allows a floor precast concrete sections to rest on a flange extending out horizontally from the precast concrete above the ground footing. This device is not a concrete block and does not interfit into a wall as does the present invention.

U.S. Pat. No. 2,198,011 to Muirhead discloses a structural wall and block construction invention which is several solid blocks of concrete that interfit and are compatible in size to a 8×8×16 inch block. In particular, a block per this patent is known by the disclosure as a R5 block which is at the footing and has a similar opening to allow liquid concrete to be poured into the side of the block. The present invention avoids and distinguishes from U.S. Pat. No. 2,198,011 for many reasons.

Firstly, the Muirhead patent block R5 is a solid block, whereby the present invention is hollow. Also, the Muirhead patent shows a channel on both sides of the block. The present invention is hollow and thereby cannot facilitate a channel on both sides, and the present invention is designed for a one sided application as the bottom concrete block directly above the footing. Since the footing is on the outer perimeter of a building, the present invention design is a one sided channel to interlock liquid concrete poured as a slab on the inside floor. The Muirhead patent illustrates a bland incline in its block channel and is completely different than the present invention well formed reverse 'C' shaped channel. The present invention reverse 'C' shaped channel interlocks the concrete into the block because the concrete cannot physically reverse its position once it is hardened. The Muirhead channel has no restrictive angle to hold the wall to the floor to prevent outward movement of the wall or separation caused by water leaks. The present invention, being a hollow block, is basically half hollow to allow a normal grout fill in the rear of the block and the upper 20% of the front of the block is a horizontal channel which is also filled with grout. Each block of the present invention is compatible with the normal size of a concrete block, is fillable in a proportional amount to the near cubic opening space of a common cinder block. The Muirhead patent has none of these features and only a bland similarity.

The above examples in which different methods are used will show that there is a need, in every-regard, to limit or eliminate cracks and seams between the footing and the floor. For the purposes of keeping out water, termites, weeds, drafts or odors; the references indicate various methods and the art used is the result of a need to correct a building problem. It was in the light of experience and not the references that the present invention was conceived.

SUMMARY OF THE INVENTION

The present invention relates to concrete block structures, and in particular, a concrete block designed to be installed directly on top of the footing. This block has three cavities, two of which are on the top and one that is a side cavity. The side cavity of the concrete block which is resting directly on top of the footing, is a floor receiving portion of the block. This portion allows concrete to be poured into the side of the block which is above the footing.

The vertical meeting point of the wall and the footing are deflected by this invention and the floor terminated ends are above the top of the footing line and inserted into half the concrete block depth thickness to create a seam that is above the footing. The third cavity, which is the floor receiving portion of the block, allows slidable reception of the concrete into its lower member and the top of the third cavity is the reverse of the bottom receiving angle of the block. This two angle difference produces a rabbet shape and serves to lock in the concrete so when the concrete hardenes a non-unified two pour wall and footing exists with the floor locked into the side of the block and above the footing line.

Accordingly, it is a primary object of the invention to provide a device that reduce potential for water, dirt and insect leaks between a floor and a footing.

Another object of the invention is to provide such a device which can be easily used and employs readily available, and easily made materials. The material preferred for the purpose of this invention is concrete, or cinder block concrete.

A further object of the invention is to provide such a device that can be used in conjunction with other devices and can fit the same length and width of an existing product. The product in this regard is a concrete block, as the present invention is a concrete block with the same length, height and depth dimensions as a common block; but with many different characteristics.

Still another object of the invention is to provide a device the same length, width and depth of a common concrete block, so the use of the present invention will fit easily and quickly into into an established concrete block schedule.

Yet another object of the invention is to provide a device that requires no additional brackets, braces or parts, to make its use preferred by its ease of installation Still a further object of the invention is to provide a device that requires no more tools than the installation of a common concrete block.

Yet a further object of the invention is to provide a device that assures the construction of a floor in a manner that creates integrity between the floor and footing and thereby prevents penetration of water, dirt, and insects into the resulting structure.

Yet another object of the invention is the provision of a device enabling a non-unified two pour whereby the wall and floor are both conjoined in the same structure above the footing level.

DETAILED DESCRIPTION OF THE INVENTION

Figure 1:
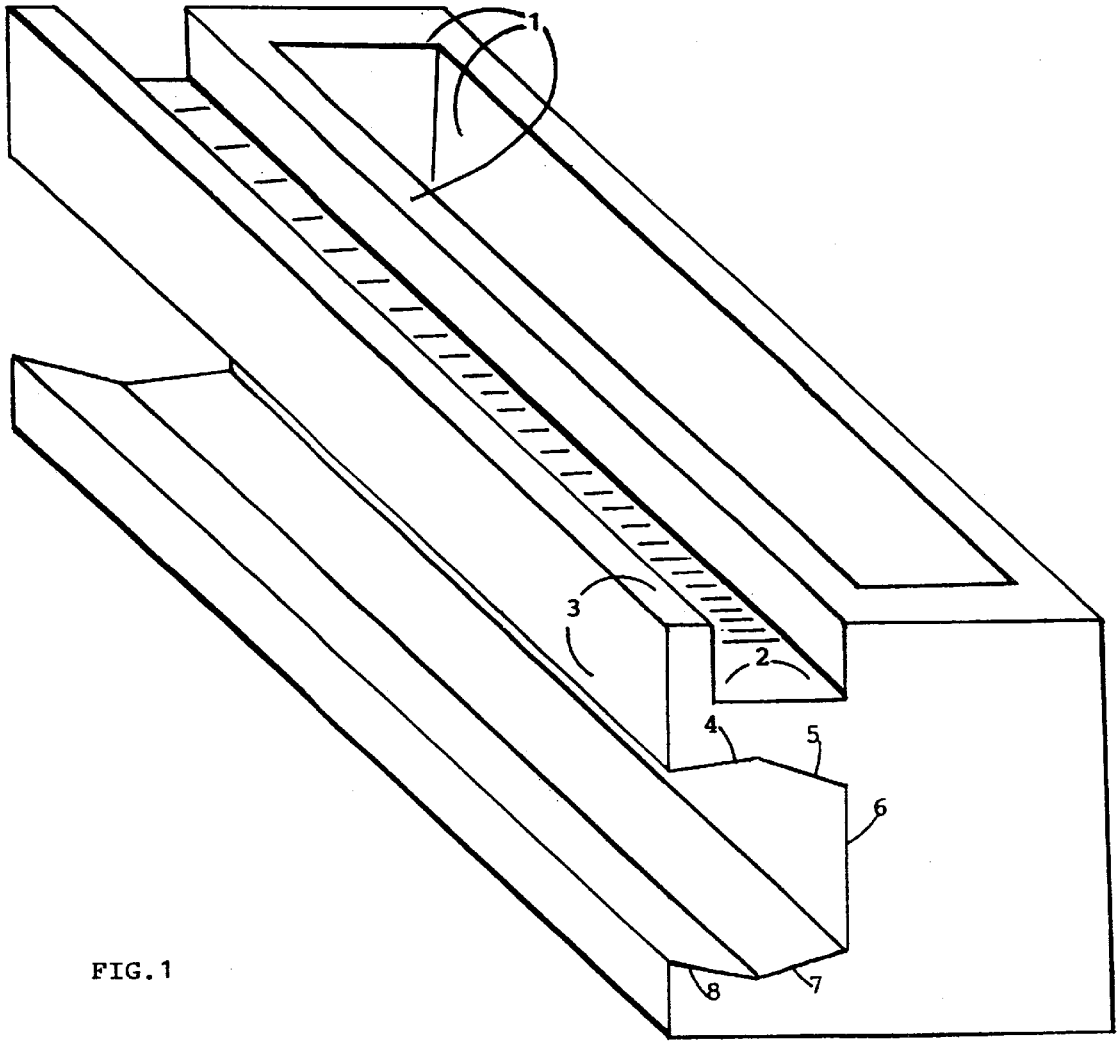
FIG. 1 is a perspective view, illustrating a floor receiving concrete block, all according to the invention.

Turn now to the drawings and, initially, to FIG. 1 which illustrates a floor receiving concrete block. 1 is the unobstructed full length cell which is open on the top and bottom. Next to 1 is 2, which is a flat solid base shortened cell made in this manner to allow normal mortaring to the block above it; and its ends are open on both sides to allow concrete filled into 2 to be a continuous fill of concrete to create a rigid wall side to compensate for the lack of a full height block on the lower side of 2. The opposing mortar edge of the block is 3, which enables a match in design to an original concrete block so that the floor receiving block can match up to any block for quick mortaring. 4 is an inverted angle inclining upwardly to create a lock for the incoming concrete. 5 is a downsliding angle to give wall thickness to 2 for transporting and handling purposes. 6 is the termination point of the horizontal cell of the block. 7 is a downsliding angle of the horizontal cell and the angle is for handling purposes, to make the block thick enough to prevent breakage. 8 is the lower inverted angle inclining downwardly to create, together with 4, a locking angle for the incoming concrete received into the block from a floor pour.

Figure 2:
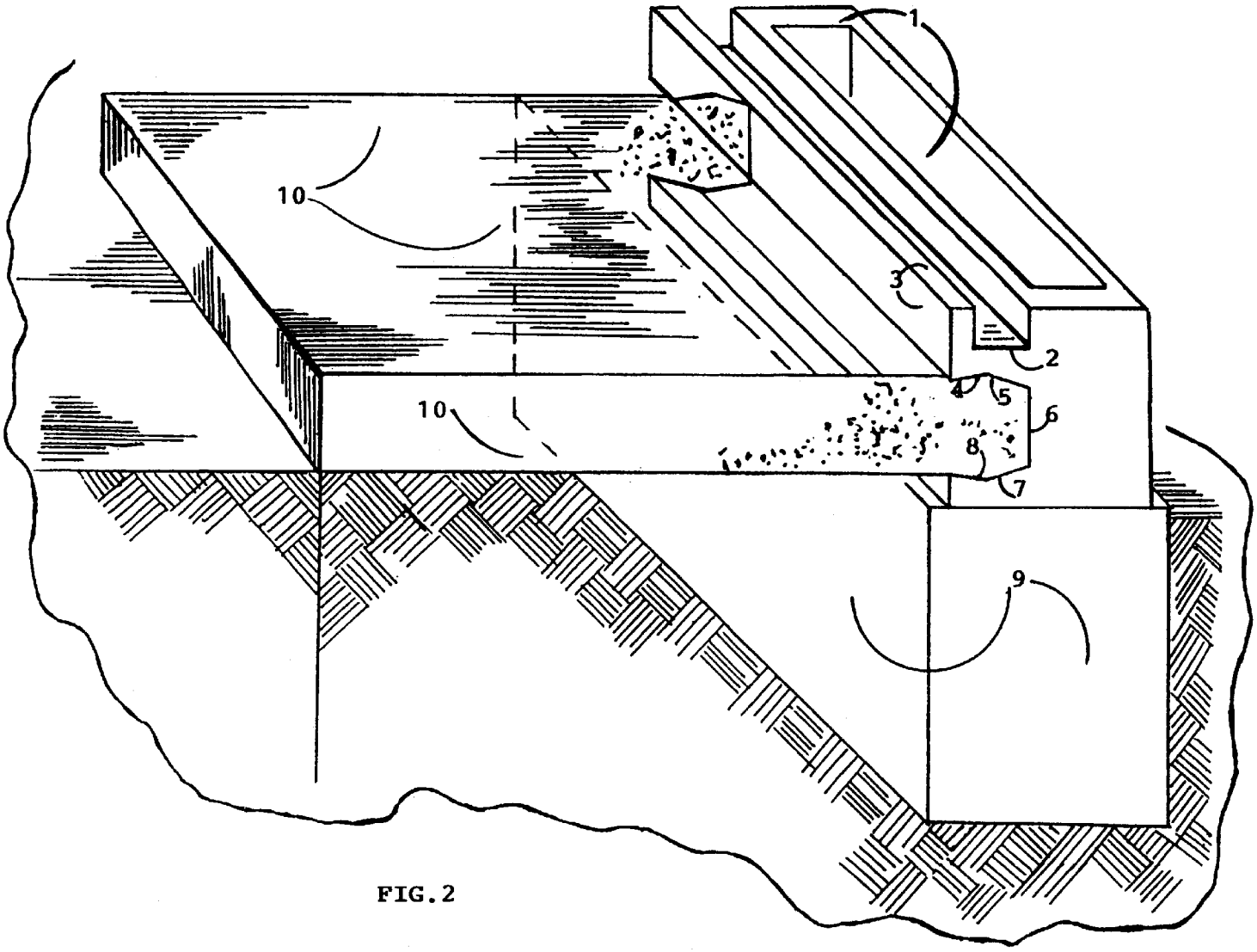
FIG. 2 is a perspective view, depicting the block according to the invention, in use; the illustration showing the block mounted on the footing and the floor concrete pour into the floor receiving block.

Turn now to FIG. 2 which illustrates the floor receiving concrete block in use. The illustration shows a floor receiving concrete block 1 through 8 mounted on top of a footing 9. The concrete 10 is poured from a floor formed in a conventional manner and with its use, the floor receiving concrete block will cause the elevation of the floor plan to be somewhat higher to enable the use of the present invention.

In conventional circumstances, the floor in concrete block construction is usually poured even with the top of the footing. To use the present invention properly, the bottom of the planned floor elevation must be raised appropriately, or the footing lowered appropriately, so that the incoming concrete and the resulting floor structure will flow into the block and fill both the top and bottom of the floor receiving concrete block.

While preferred embodiments of the invention have been disclosed in detail, it should be understood by those skilled in the art that few, if any, modifications can be made to the illustrated embodiments without departing from the scope of the invention.

I claim:

1. A structural concrete block for foundation wall and floor comprising:

a substantially rectangular concrete hollow body form of a width and height corresponding to that of standard, or other concrete blocks with which it is to be used;

said concrete block having a first opening comprising an open cell extending along the length of said block from end to end, and substantially half the width of said block, beginning at the center of said block, and continuing substantially to the rear of said block;

said cell extending unobstructed from a top of said block to a bottom of said block;

said block further including a second opening for the reception of liquid concrete;

said second opening extending along the top of said block and along its length said second opening being open at the top and its end and extending from the center of said block to the front of said block, wherein a solid flat shortened base defining a shortened cavity of the upper portion of the block is formed.

2. A structural concrete block for foundation wall and floor as defined in claim 1, wherein said block includes means to interlock liquid concrete from a floor slab;

said means comprising a third opening in a front vertical face of the block and extending lengthwise the entire length of said block with open unobstructed ends;

said unobstructed ends forming means to connect one said block to another block and to form a continuous opening for the planned length and width of a floor plan as an opening entry cavity to include a liquid concrete floor to engage said entry cavity and to solidify inside of the third opening thereby connecting the block and the slab floor in a solidified union of concrete;

said third opening at the bottom front of the block and extending more than halfway up the block height and opening halfway into the width of the block;

the shape of said third opening having the front of said opening projecting at a downward angle and at the upper rear of the front of said opening projecting at an upward angle and the center of upward angle projecting downwardly and terminating at a vertical wall;

said shape being relatively conical in shape and the same on the top of the opening as well as the bottom of the opening and that the conical shape of said opening is a dimension that enables liquid concrete poured into the said third opening to be non-removable at the time the concrete sets and a means provided to interlock the resulting floor slab with its use.

* * * * *